US008596490B2

(12) United States Patent
Davidson et al.

(10) Patent No.: US 8,596,490 B2
(45) Date of Patent: Dec. 3, 2013

(54) FOOD TRAY WITH INTEGRATED LIQUID-RETENTION SYSTEM

(75) Inventors: Ryan P. Davidson, Evansville, IN (US); Gail S. Becke, Hoffman Estates, IL (US); Jeffrey C. Minnette, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 13/402,738

(22) Filed: Feb. 22, 2012

(65) Prior Publication Data

US 2012/0211497 A1 Aug. 23, 2012

Related U.S. Application Data

(60) Provisional application No. 61/445,169, filed on Feb. 22, 2011.

(51) Int. Cl.

| | |
|---|---|
| ***B65D 1/36*** | (2006.01) |
| ***B65D 85/00*** | (2006.01) |
| ***B65D 1/34*** | (2006.01) |
| ***B65D 6/04*** | (2006.01) |

(52) U.S. Cl.
USPC ..... 220/608; 220/507; 220/571; 220/572; 206/562; 206/563

(58) Field of Classification Search
USPC ..... 220/507, 571, 572, 608, DIG. 6; 206/562, 563
See application file for complete search history.

(56) References Cited

U.S. PATENT DOCUMENTS

| | | | | |
|---|---|---|---|---|
| 2,974,843 | A * | 3/1961 | Reifers et al. | 229/407 |
| 4,195,746 | A * | 4/1980 | Cottrell | 220/4.24 |
| 4,533,585 | A * | 8/1985 | Holden | 428/116 |
| 4,935,276 | A | 6/1990 | Pawlowski et al. | |
| 4,935,282 | A | 6/1990 | Pawlowski et al. | |
| 5,250,310 | A | 10/1993 | Fujino et al. | |
| 6,598,740 | B1 * | 7/2003 | Wiegers | 206/204 |

* cited by examiner

*Primary Examiner* — Anthony Stashick
*Assistant Examiner* — Madison L Poos
(74) *Attorney, Agent, or Firm* — Barnes & Thornburg LLP

(57) ABSTRACT

A tray in accordance with the present disclosure includes a floor and a side wall arranged to extend along a perimeter edge of the floor. The floor and the side wall cooperate to form a product-storage region.

19 Claims, 10 Drawing Sheets

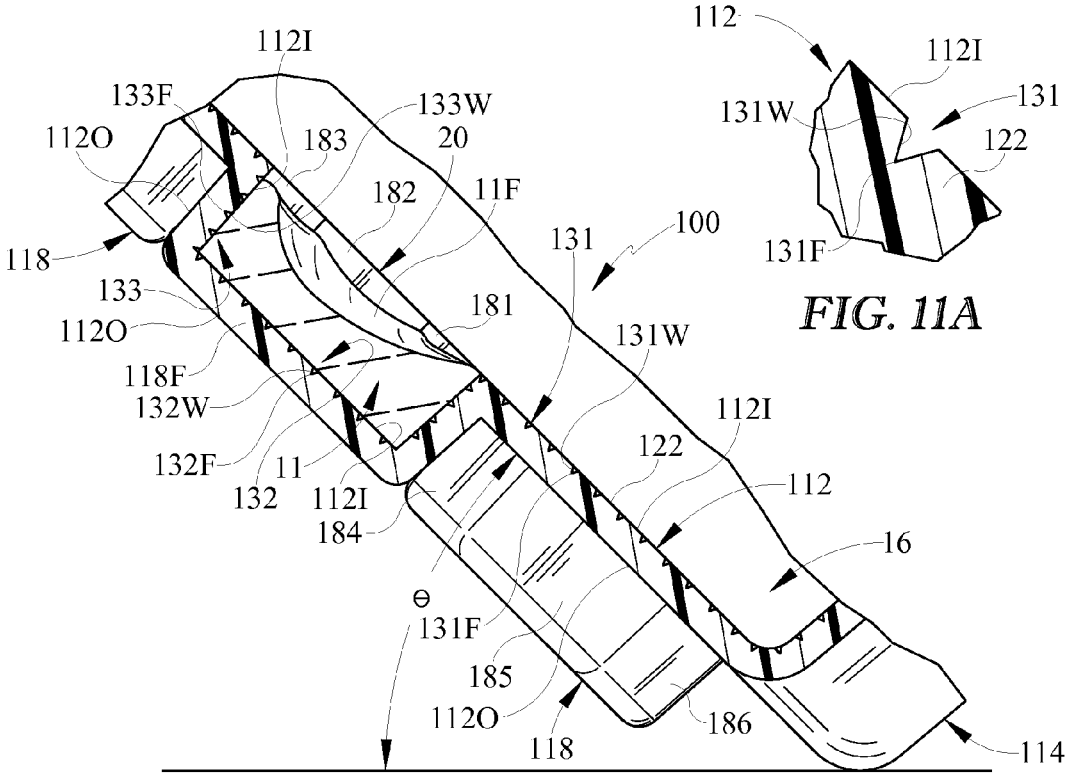
FIG. 11A
FIG. 11
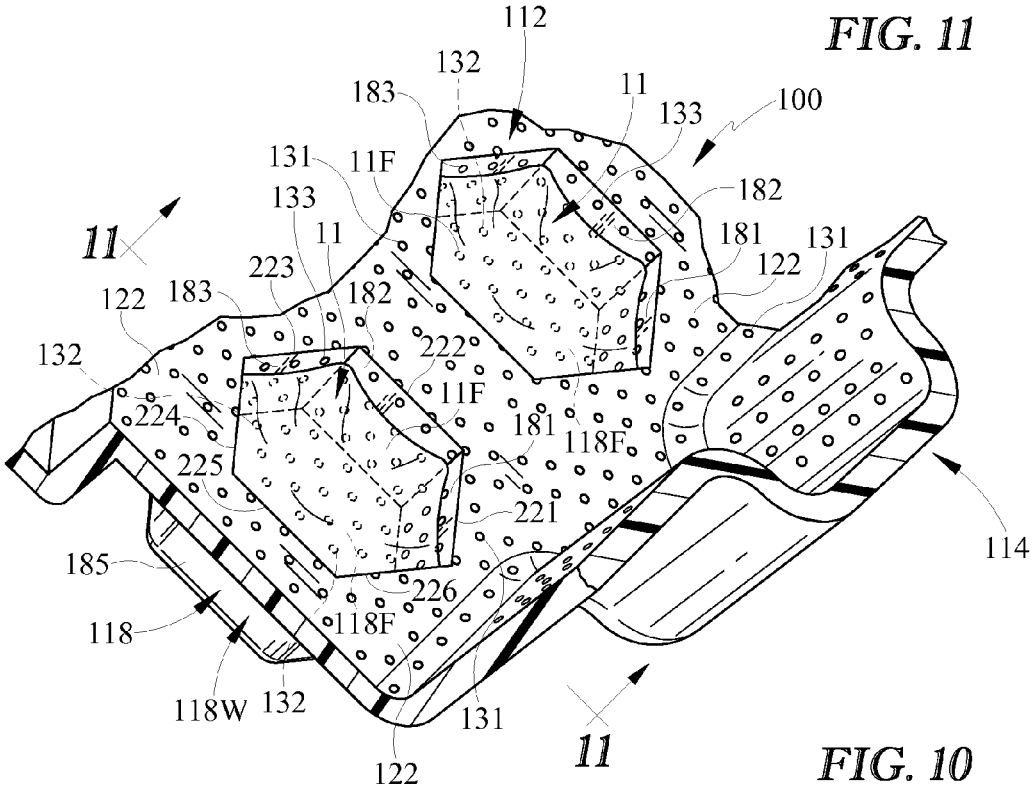
FIG. 10

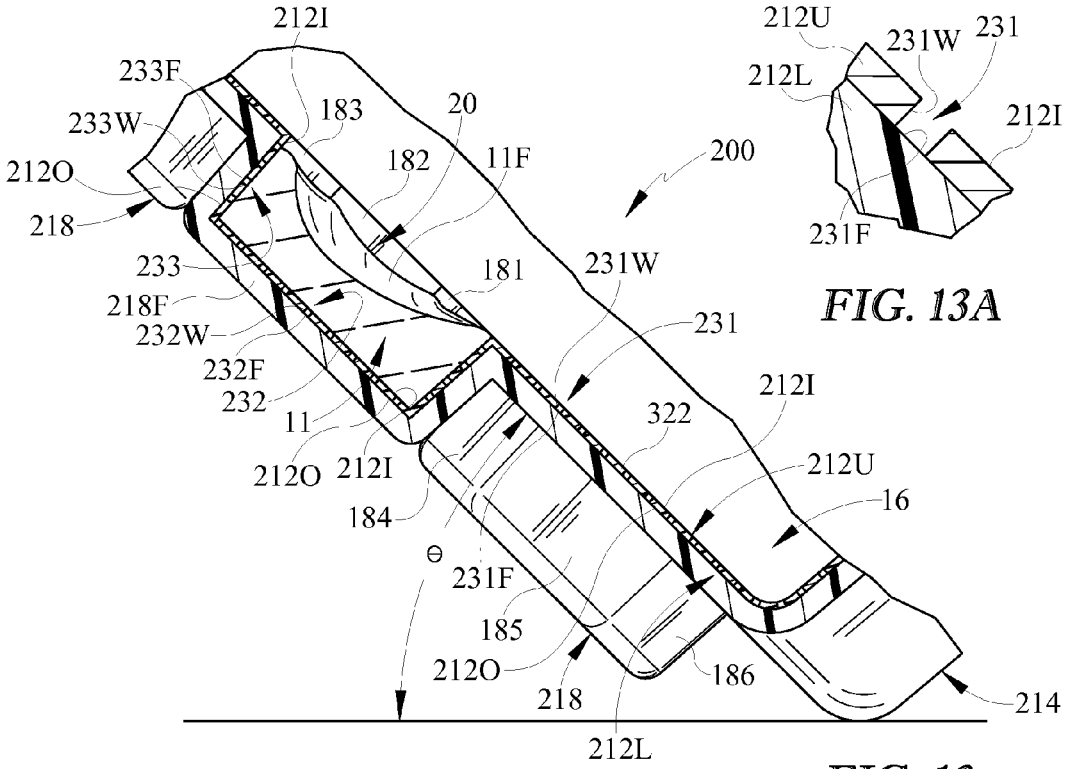
FIG. 13A
FIG. 13
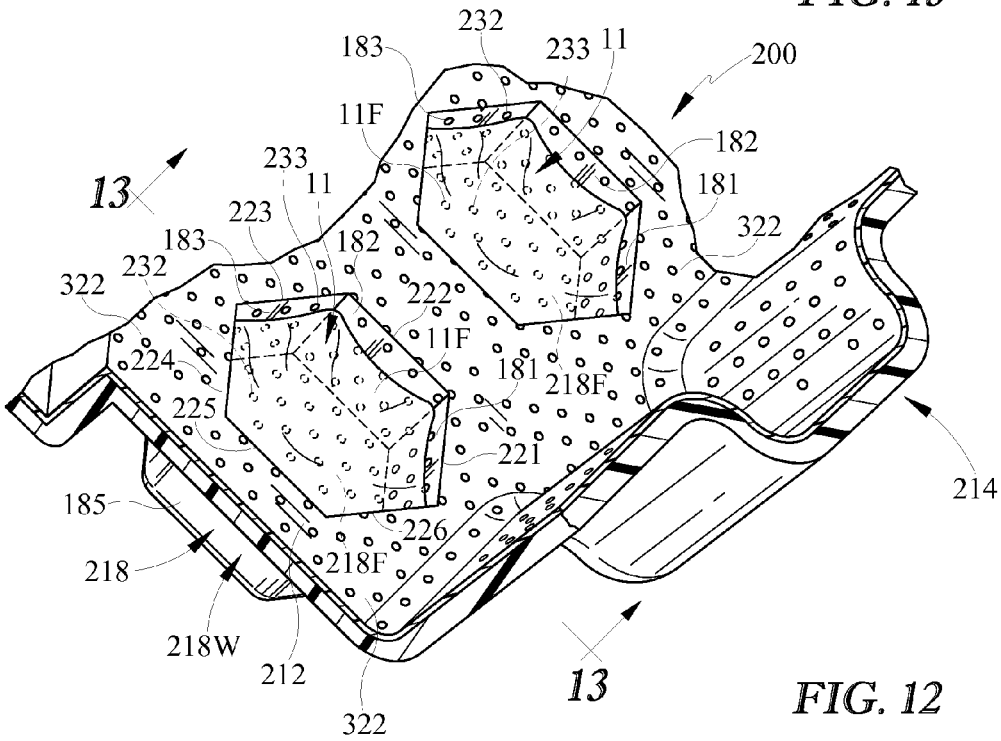
FIG. 12

FOOD TRAY WITH INTEGRATED LIQUID-RETENTION SYSTEM

PRIORITY CLAIM

This application claims priority under 35 U.S.C. §119(e) to U.S. Provisional Application Ser. No. 61/445,169, filed Feb. 22, 2011, which is expressly incorporated by reference herein.

BACKGROUND

The present disclosure relates to containers, and particularly to containers for storing food. More particularly, the present disclosure relates to a food-storage tray for storing meats and other foods.

SUMMARY

A tray in accordance with the present disclosure includes a floor and a side wall arranged to extend along a perimeter edge of the floor. The floor and the side wall cooperate to form a product-storage region.

In illustrative embodiments, the tray floor is formed to include an array of liquid-storage basins and a web coupled to the brim of each of the liquid-storage basins. Each liquid-storage basin is supported in a stationary position by the web to cause the liquid-receiving chamber formed in each liquid-storage basin to communicate with the overlying product-storage region bounded by the tray floor and tray side wall.

In illustrative embodiments, a liquid-storage basin included in a tray floor in accordance with the present disclosure has a relatively small volume, depth, and lateral width selected to enhance the possibility that liquid discharged or excreted by a product kept in the food-storage region will be retained in the liquid-receiving chamber formed in each liquid-storage basin even when the tray is tilted to a steep tilt angle. Each liquid-storage basin is configured to provide means for causing a free surface of liquid stored in its chamber formed in the companion liquid-storage basin to act like a membrane under tension so that such liquid is retained in the chamber whether the tray is level or tilted. A liquid-retention system in accordance with the present disclosure is effective without the inclusion of an absorbent pad on the floor of the tray.

In illustrative embodiments, the web in the tray floor is formed to include an array of basin apertures spread in spaced-apart relation across the length and width of the tray floor. Each basin aperture is associated with one of the liquid-storage basins and arranged to open into the liquid-receiving chamber formed in the associated liquid-storage basin. Each of the basin apertures is bordered by a border edge included in the web. The border edge comprises a series of serially connected web segments (e.g., six) arranged at angles to one another and coupled to the brim of the liquid-storage basin.

Also in illustrative embodiments, the liquid-storage basin has a hexagonal basin floor and a basin side wall that is hexagonal in cross-section. The basin side wall depends from a hexagonal border edge formed in the web of the tray floor to define an aperture opening into the liquid-receiving chamber formed in the liquid-storage basin. While hexagonal basin structures are used in one illustrative embodiment, it is within the scope of the present disclosure to use other curved and multi-sided structures.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIGS. 10 and 11 show a second embodiment of a tray floor in a tray in accordance with the present disclosure and show formation of an array of micro-bore reservoirs in portions of the tray floor including one or more of the web, a basin floor, and a basin side wall;

FIG. 11A is an enlarged diagrammatic view of one of the micro-bore reservoirs shown in FIG. 11;

FIGS. 12 and 13 show a third embodiment of a tray floor in a tray in accordance with the present disclosure and show that the tray comprises upper and lower layers that cooperate to form the web and each of the liquid-storage basins and that the upper layer is formed to include an array of micro-bore reservoirs in one or more of the web, a basin floor, and a basin side wall; and FIG. 13A is an enlarged diagrammatic view of one of the micro-bore reservoirs shown in FIG. 13.

DETAILED DESCRIPTION

Figure 1:
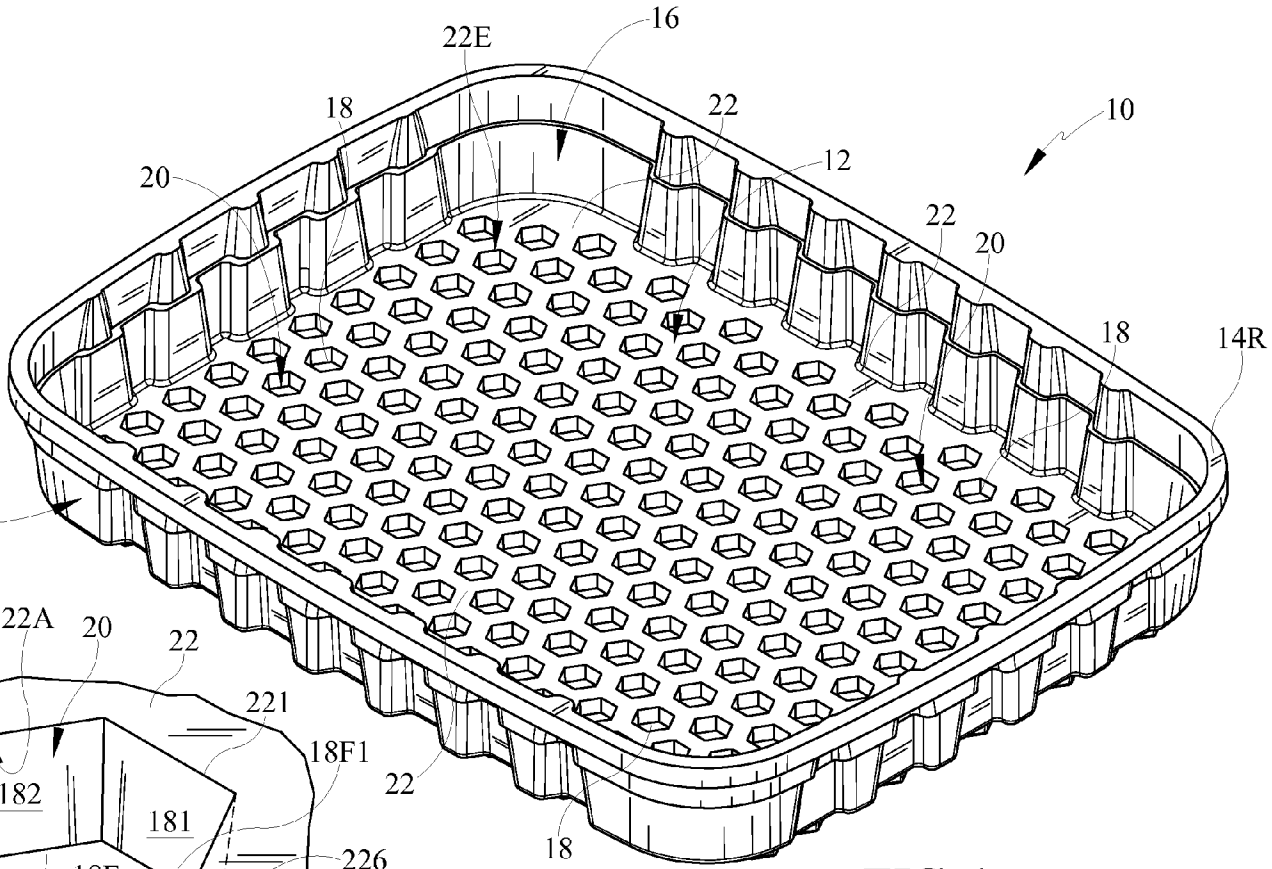
FIG. 1 is a perspective view of a food tray in accordance with the present disclosure showing formation of the tray floor to include an array of small hexagonal upwardly opening liquid-storage basins and a web coupled to tray side walls included in the food tray and to each of the liquid-storage basins and showing that the web is formed to include a series of hexagonal basin apertures wherein each hexagonal basin aperture opens into an interior region (i.e., chamber) of a companion one of the liquid-storage basins.

Tray 10 includes a tray floor 12 and a tray side wall 14 extending along a perimeter edge of tray floor 12 as suggested in FIG. 1. Tray floor 12 and tray side wall 14 cooperate to form a product-storage region 16. Tray floor 12 includes an array of spaced-apart liquid-storage basins 18 as suggested in FIG. 1. Each basin 18 is configured to provide a chamber 20 communicating with product-storage region 16 to receive liquid 11 discharged by a product (e.g., meat or other food) kept in product-storage region 16 and retain such liquid 11 in the chamber 20 even when tray 10 is tilted as suggested in FIGS. 8 and 9 to assume a steep inclined position.

Figure 2:
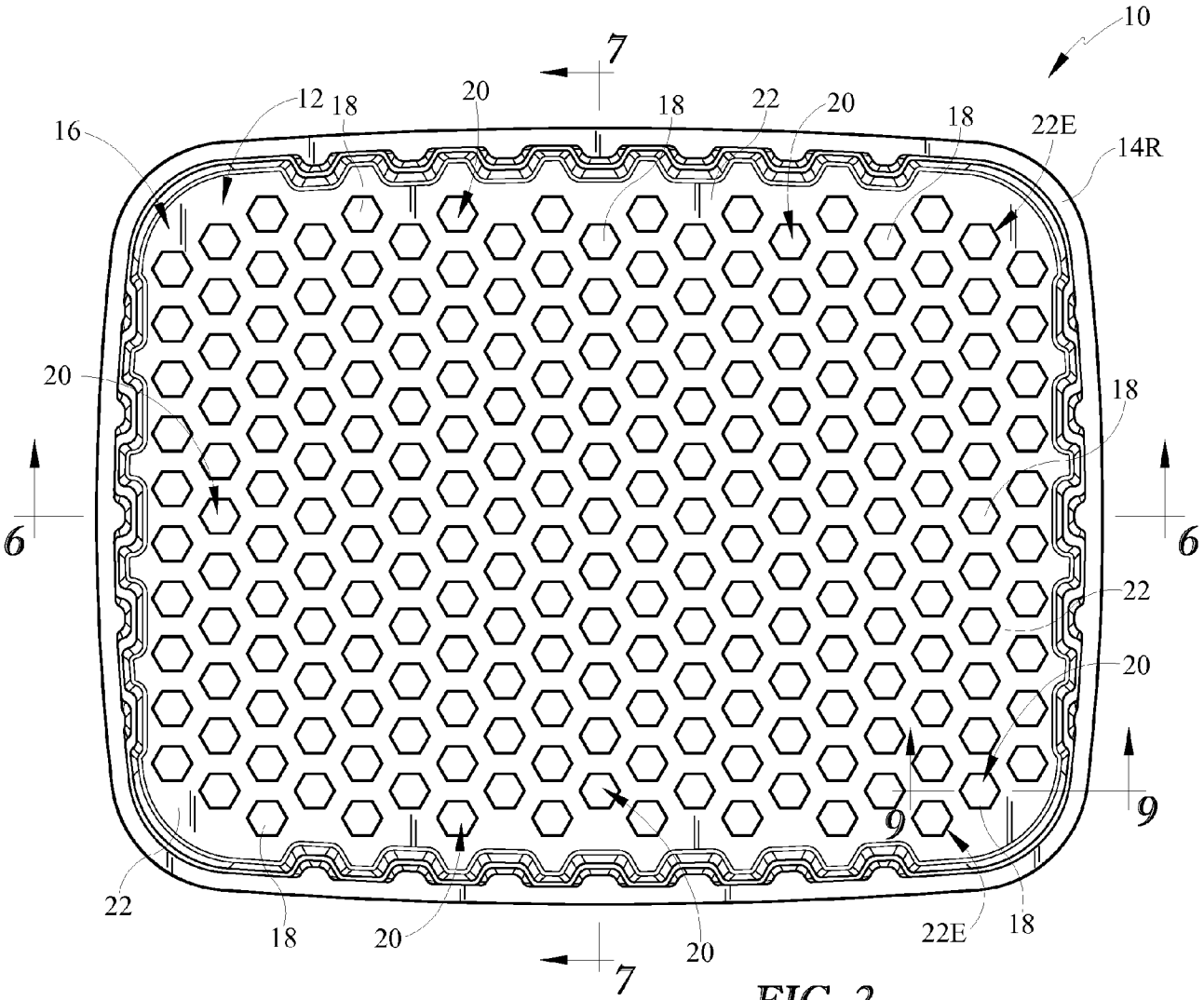
FIG. 2 is a top plan view of the food tray of FIG. 1.
Figure 3:
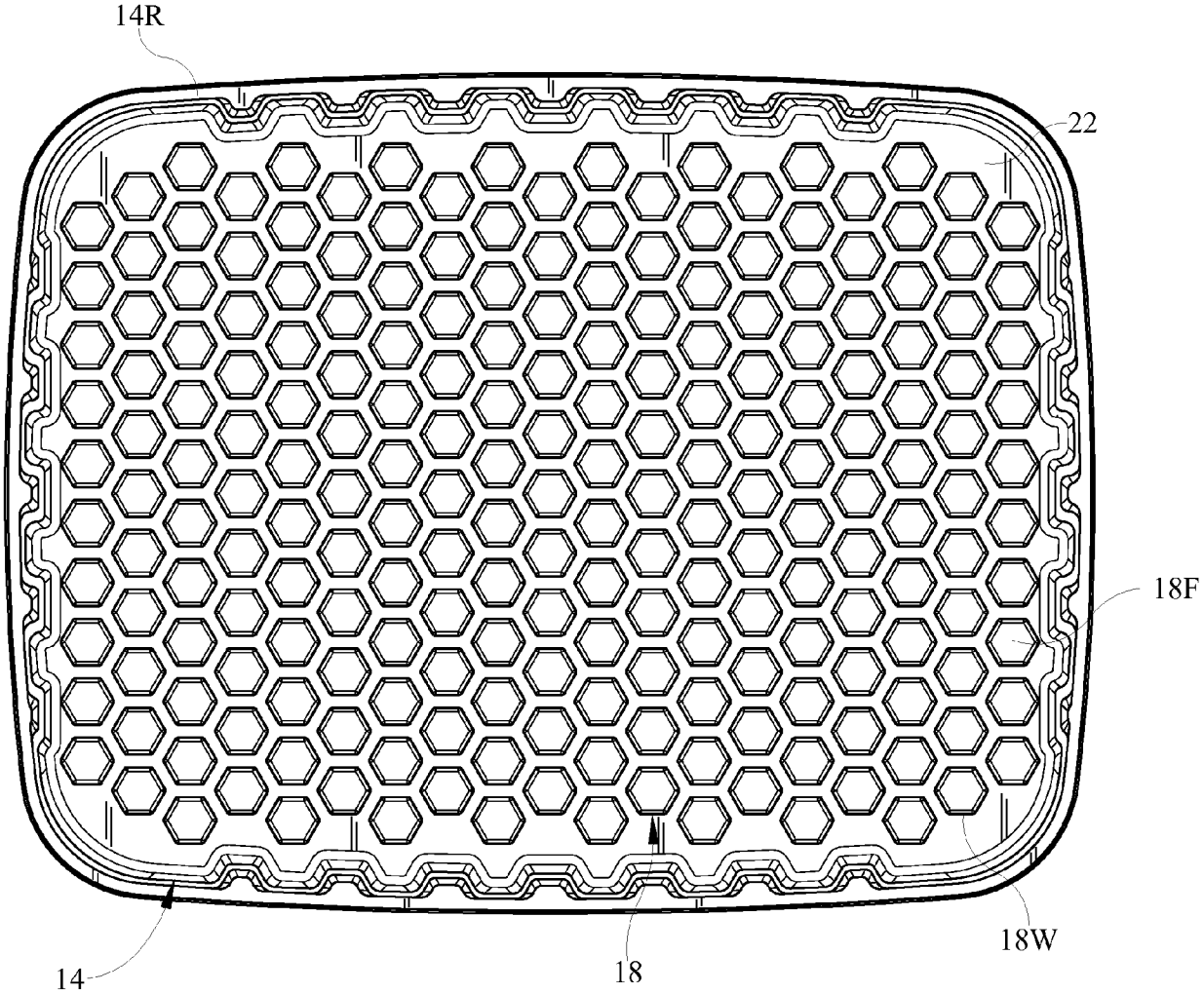
FIG. 3 is a bottom view of the food tray of FIG. 1.
Figure 4:
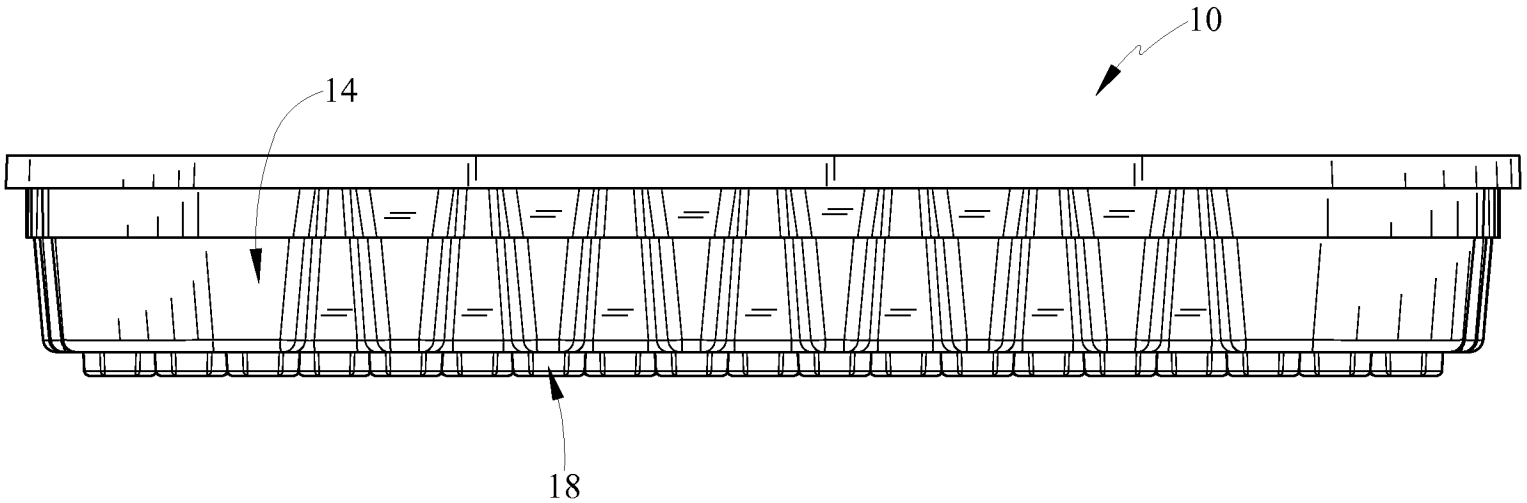
FIG. 4 is a side elevation view of the food tray of FIG. 1.
Figure 5:
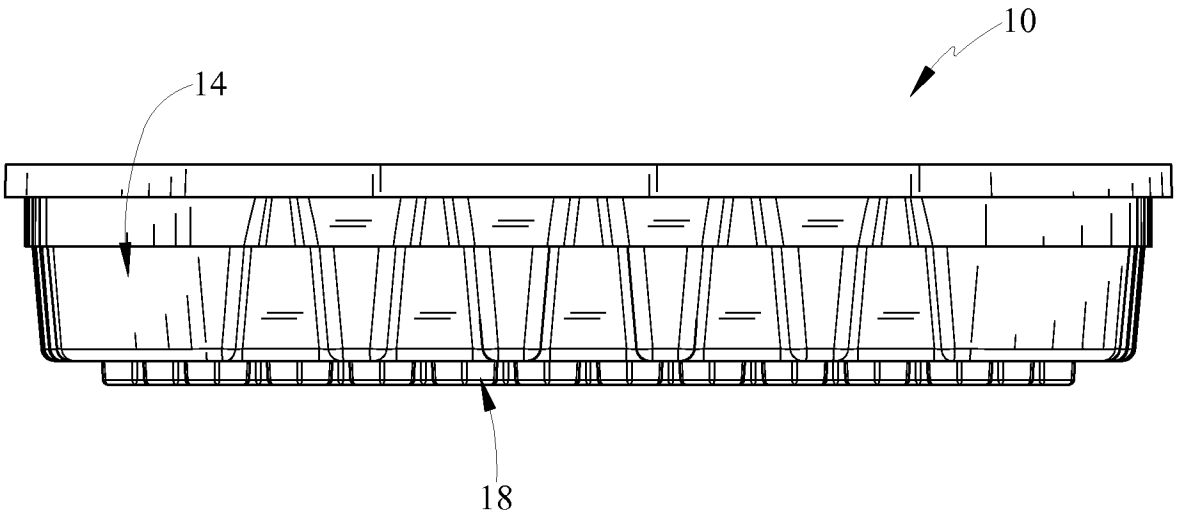
FIG. 5 is an end elevation view of the food tray of FIG. 1.
Figure 6:
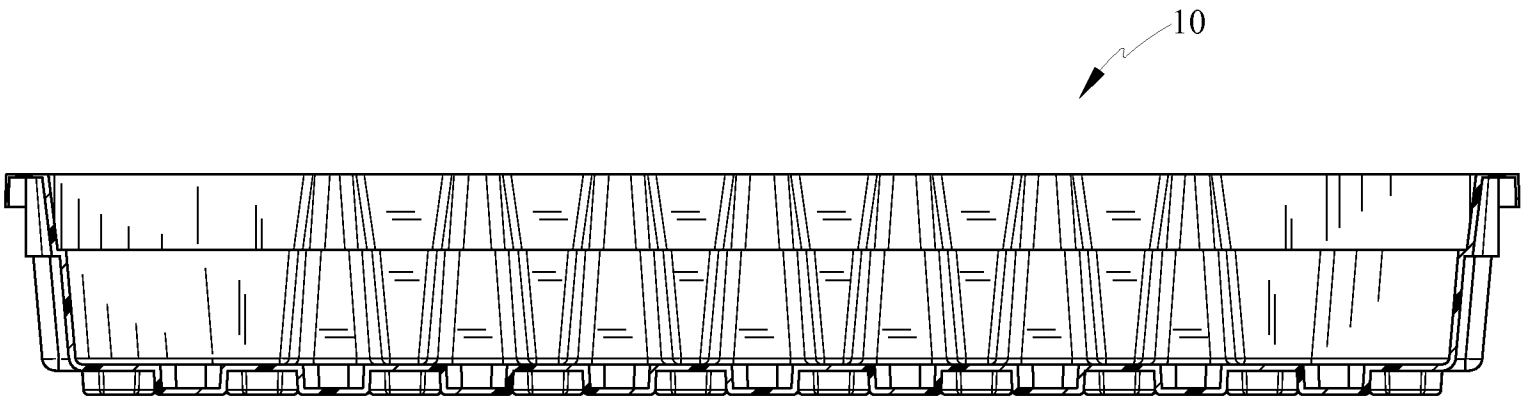
FIG. 6 is a sectional view taken along line 6-6 of FIG. 2.
Figure 7:
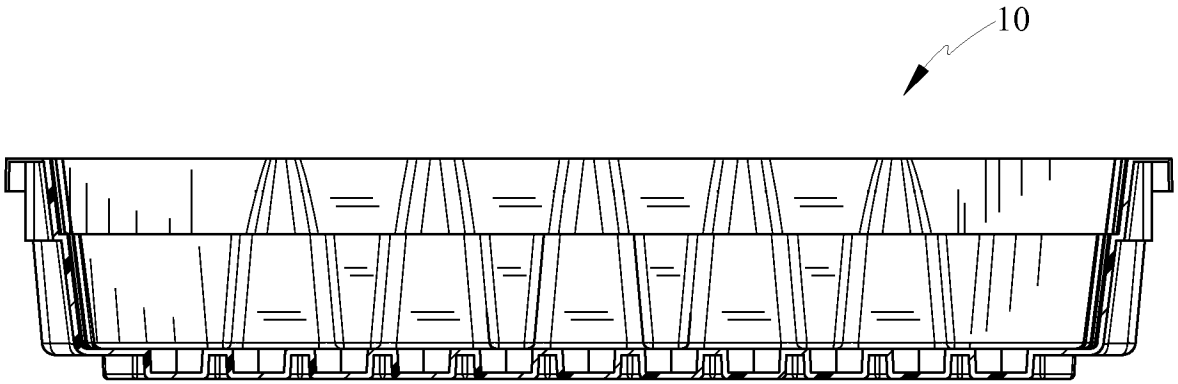
FIG. 7 is a sectional view taken along line 7-7 of FIG. 2.

Tray floor 12 includes a web 22 coupled to a brim of each of the liquid-storage basins 18 and coupled to tray side wall 14 as suggested in FIGS. 1 and 2. Web 22 is arranged to support any product (not shown) deposited into product-storage region 16 so that liquid 11 discharged from the stored product can fall by gravity into chambers 20 provided in the underlying liquid-storage basins 18. Tray floor 12 is a monolithic structure in an illustrative embodiment as suggested in FIGS. 1-9.

In other illustrative embodiments shown in FIGS. 10-11 and 12-13, the tray floor is formed to include an array of very small-sized micro-bore reservoirs configured to receive and retain some of the liquid 11 discharged from product supported on the tray floor. In one embodiment, tray floor 112 is made of a monolithic material and micro-bore reservoirs 131, 132, 133 are formed in web 122 and/or the floor 118F and/or side wall 118W of each liquid-storage basin 118 as suggested in FIGS. 10-11. In another embodiment, tray floor 212 is multi-layered and includes an unperforated lower (substrate) layer 212L and an overlying perforated upper layer 212U formed to include micro-bore reservoirs 231, 232, 233 that are formed in portions of the perforated upper layer 212U defining the web 322 and/or portions of the liquid-storage basin 218.

In an illustrative embodiment shown in FIGS. 1-9, each liquid-storage basin 18 includes a basin floor 18F and a basin side wall 18W arranged to cooperate with basin floor 18F to define chamber 20 as suggested in FIG. 2. Basin side wall 18W is arranged to extend from web 22 in a downward direction to mate with a companion basin floor 18F. In an illustrative embodiment, basin floor 18F has a hexagonal shape and basin side wall 18F also has a hexagonal shape (in cross-section) and comprises a series of six serially connected flat panels 181-186 as suggested in FIG. 2. Each of panels 181-186 of a liquid-storage basin 18 is coupled to one of six serially connected side edges 18F1-18F6 included in hexagonal basin floor 18F as suggested in FIG. 1A.

Figure 1A:
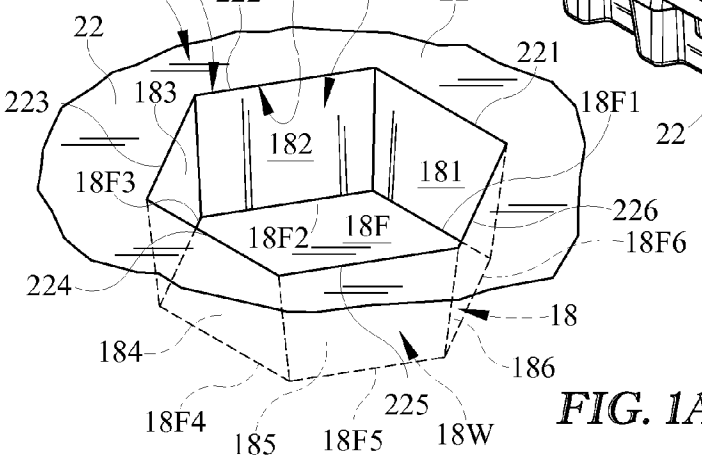
FIG. 1A is an enlarged perspective view of a portion of the tray floor of FIG. 1 showing one of the liquid-storage basins and a portion of the web surrounding that liquid-storage basin and showing the web is formed to include a basin aperture opening into a liquid-receiving chamber formed in the liquid-storage basin and that the basin aperture is bounded by a border edge comprising six serially connected web segments included in the web of the tray floor.

Web 22 is formed to include a series of basin apertures 22A and each basin aperture 22A opens into one of the chambers 20 formed in a companion liquid-storage basin 18 as suggested in FIGS. 1 and 1A. In an illustrative embodiment, each basin aperture 22A has a hexagonal shape and is bordered by a border edge 22E comprising a series of six serially connected web segments 221-226 as suggested in FIG. 2. It is within the scope of this disclosure to configure web 22 to include a border edge 22E that borders basin aperture 22A and has any suitable curved or multi-sided shape. Each of web segments 221-226 is straight in an illustrative embodiment. Each of panels 181-186 in basin side wall 18W is coupled to a companion one of the web segments 221-226 as suggested, for example, in FIG. 1A.

Tray side wall 14 is coupled to a perimeter edge of web 22 of tray floor 12 and arranged to extend upwardly away from the array of liquid-storage basins 18 coupled to web 22 as suggested in FIG. 1. Tray side wall 14 terminates at a top rim 14R as suggested in FIG. 2.

Web 22 is configured to provide means for supporting food deposited into food-storage region 16 above the liquid-storage basins 18 to cause any liquid 11 discharged from the food to fall by gravity into chambers 20 formed in the underlying liquid-storage basins 18 and for causing a free surface 11F of liquid 11 stored in a chamber 20 of a liquid-storage basin 18 to act like a membrane under tension so that such liquid 11 is retained therein while web 22 is level and while web 22 is inclined with respect to a horizontal plane at an acute angle θ. In an illustrative embodiment, angle θ is about 50° as shown in FIG. 9.

Figure 9:
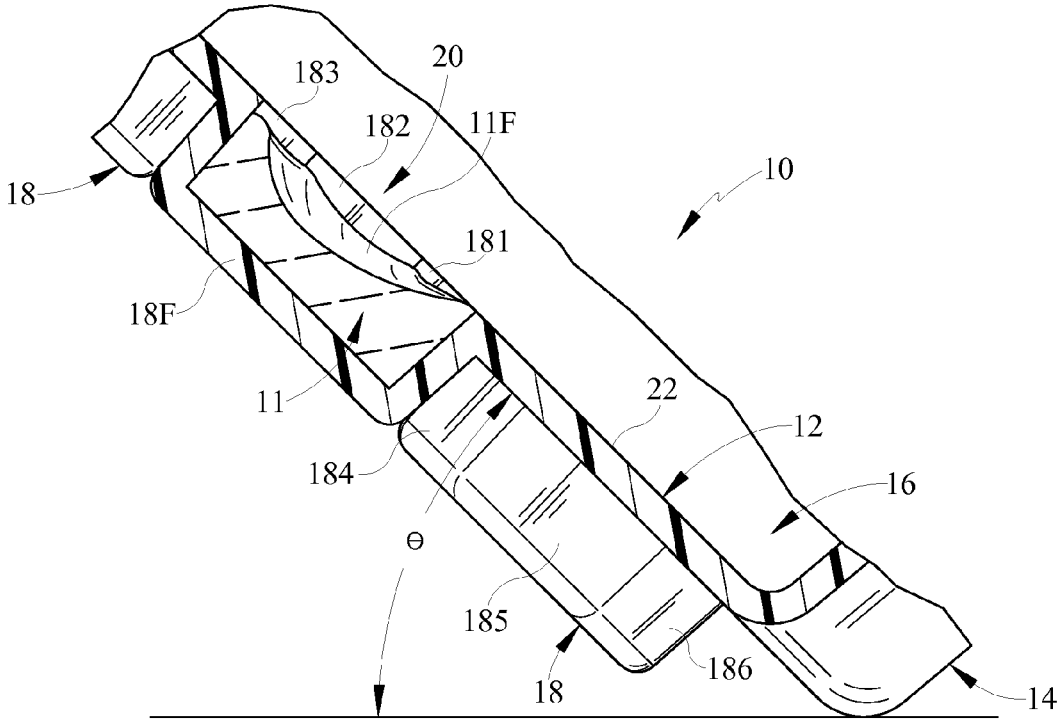
FIG. 9 is a sectional view taken along line 9-9 of FIG. 2 after the food tray is tilted to the 50° tilt angle shown in FIG. 8.
Figure 8:
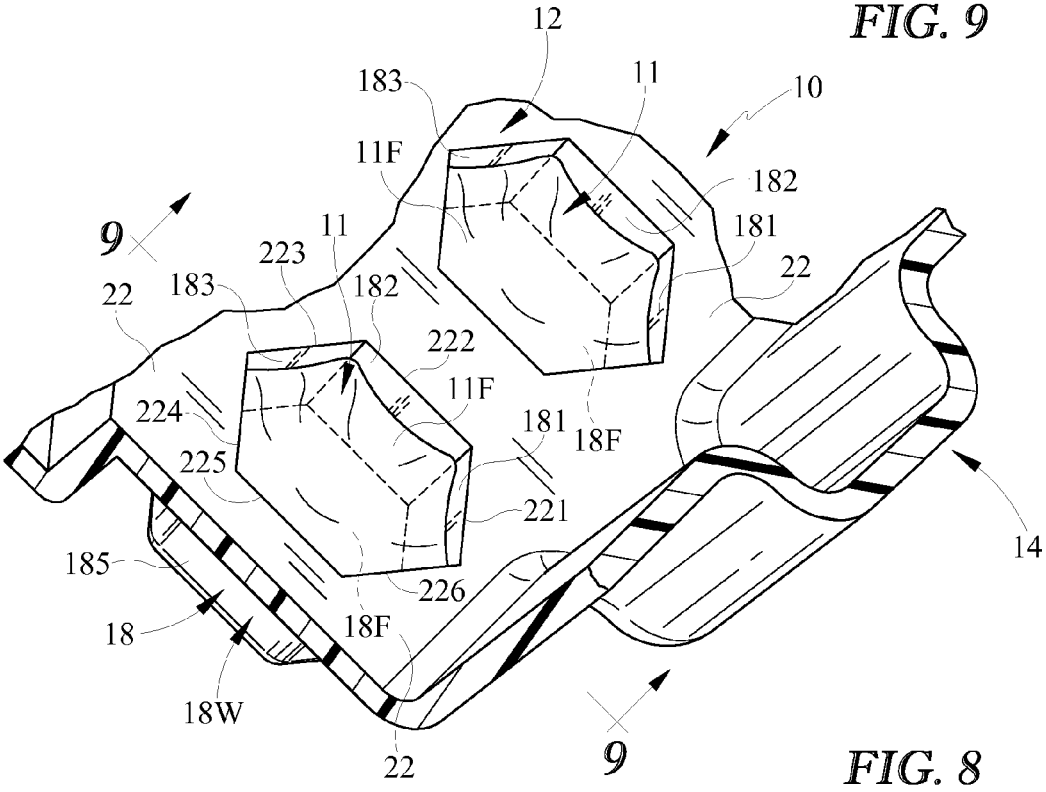
FIG. 8 is an enlarged perspective view of several liquid-storage basins shown in FIG. 1 after the food tray has been tilted to a tilt angle of about 50° and showing that liquid that has been discharged from food stored in the tray and accumulated in chambers formed in each of those liquid-storage basins is retained in the interior regions of those liquid-storage basins owing, in part, to surface tension of the retained liquid even though the food tray is tilted from a horizontal position to an inclined position.

Liquid-storage basins 18 are configured and located to receive and retain liquid 11 discharged or otherwise excreted from meat or other food or items stored on web 22 in product-storage region 16 of tray 10 so that such liquids 11 are retained in tray 10 owing at least in part, to surface tension of a free surface 11F of the liquid 11 without the use of any separate absorbent pad on floor 12 of tray 10 as suggested in FIGS. 8 and 9. The structure, small size, and volume of the chamber 20 provided in each liquid-storage basin 18 enhances surface tension properties of liquid 11 received in chamber 20 formed in a liquid-storage basin 18. Liquid 11 extant in a chamber 20 formed in a liquid-storage basin 18 will remain associated with that chamber 20, even though tray 10 may be tilted through an angle θ to assume a relatively steep slope as suggested in FIGS. 8 and 9. Angle θ represents a tilt angle of about 50° in the illustrated embodiment.

Surface tension is a property of liquids that causes the free surface 11F of liquid in each chamber 20 provided in liquid-storage basin 18 to act like a very thin film or membrane under tension. Molecules of the liquid that comprise the free surface are attracted to other molecules of the liquid located inside the liquid and away from the free surface. It has been observed that a free surface 11F of liquid 11 in chamber 20 of an illustrative liquid-storage basin 18 has a characteristic outwardly facing concave shape as suggested in FIGS. 8 and 9.

It has been observed during the development of the present disclosure that a relationship exists between surface tension properties of a liquid retained in a small chamber formed in a liquid-storage basin in accordance with the present disclosure and the relatively small volume, depth, and internal width dimension of the chamber. It has also been observed in illustrative embodiments that serially connected panels 181-186 and/or web segments 221-226 arranged at angles to one another to define a basin aperture 22A in accordance with the present disclosure perform well to retain liquid in the companion chamber. The surface tension of a liquid is often expressed as dynes-per-centimeter.

In an illustrative example, the liquid 11 coming off of meat stored in liquid-storage basins 18 consists essentially of saline. Surface tension data is provided in Table 1 below.

Surface tension by definition is a force existing between the surface molecules, which cause a drop of liquid to spread or to concentrate when placed on a surface. This phenomenon depends on the values of cohesive forces (forces of attraction resulting from the forces that the liquid molecules exert between themselves) and adhesive forces (forces that the surface molecules exert on contact with those of a liquid). It has been shown that a reduction in surface tension increases the penetration capability and its flow into remote areas.

Surface tension was evaluated using a Du Nuoy Tensiometer (DST9005, Nima Technology Ltd., England) and pH was evaluated using a pH meter (Digital pH tester, V.M. Tecknologies, India). The working principle of the Du Nuoy Tensiometer is based on the force required to detach a platinum wire ring from a liquid surface or from the interface between the two liquids. Distilled water was used as zero calibration. All glass equipment from the tensiometer were cleaned by immersion in the cleaning solution and the platinum ring was cleaned by flaming. The measurements were taken at room temperature. Values were recorded and then tabulated. A paired t test was used to analyze the surface tension and pH values. The confidence limit was 95%.

TABLE 1

Mean surface tension and mean pH values for the vehicles

| Groups | Mean surface tension + SD (dynes/cm) | Mean pH + SD |
|---|---|---|
| Distilled water (Ia) | 70.5 + 2.2 | 6 + 0.3 |
| Saline (Ib) | 68.1 + 3.3 | 6.5 + 0.3 |
| Anaesthetic solution (Ic) | 44.9 + 2.2 | 5.5 + 0.3 |
| Chlorhexidine (Id) | 39.8 + 1.1 | 6 + 0.1 |
| Glycerin (Ie) | 61.7 + 3.8 | 6.5 + 0.2 |

A food-storage tray 10 in accordance with a first embodiment of the present disclosure includes a tray floor 12 and a tray side wall 14 arranged to extend along an edge of tray floor 12 and to cooperate with tray floor 12 to form a product-storage region 16 as shown, for example, in FIG. 1. Tray floor 12 is formed to include an array of liquid-storage basins 18 and a web 22 coupled to tray side wall 14 and to a brim of each of liquid-storage basins 18 as suggested in FIGS. 1, 1A, and 8.

Each of liquid-storage basins 18 is formed to include chamber means 20 communicating with product-storage region 16 as suggested in FIGS. 1 and 1A for receiving and retaining liquid 11 discharged from food deposited into product-storage region 16 and supported on web 22 so that such liquid 11 is collected in at least one of the chamber means 20 as suggested in FIG. 8 without the use of any separate absorbent pad supported on web 22 and located between web 22 and the food. Each liquid-storage basin 18 is configured to provide means for causing a free surface 11F of liquid 11 stored in it's chamber means 20 to act like a membrane under tension so that such stored liquid 11 is retained in the chamber means 20 whether tray 10 is level or tilted as suggested in FIGS. 8 and 9.

Each liquid-storage basin 18 includes a basin floor 18F and a basin side wall 18W as suggested in FIG. 1A. Basin floor 18F is located below and in spaced-apart relation to web 22. Basin side wall 18W is arranged to interconnect basin floor 18F and web 22 and cooperate with basin floor 18F to define the chamber means 20 thereof.

Basin floor 18F has a hexagonal shape and six serially connected side edges 18F1-18F6 in an illustrative embodiment as suggested in FIGS. 1 and 1A. Basin side wall 18W has a hexagonal shape in cross section and comprises a series of six serially connected panels 181-186. Each of the panels 181-186 is coupled to one of the six serially connected side edges 18F1-18F6 included in basin floor 18F. Basin side wall 18W is coupled at a lower end thereof to a companion basin floor 18F and at an upper end thereof to the series of serially connected web segments that cooperate to define a companion basin aperture 22A.

Web 22 is formed to include an array of basin apertures 22A as suggested in FIGS. 1 and 1A. Each basin aperture 22A opens into the chamber means 20 formed in one of liquid-storage basins 18. Each basin aperture 22A has a hexagonal shape and is bordered by a border edge 22E comprising a series of six serially connected web segments 221-226. Each of the six serially connected panels 181-186 is coupled to a companion one of the web segments 221-226 as suggested in FIG. 1A. Each of the panels 181-186 is flat in an illustrative embodiment. Each of the panels 181-186 has a rectangular shape in an illustrative embodiment.

The series of serially connected web segments 221-226 and/or serially connected panels 181-186 cooperate to define surface-tension means for causing a free surface 11F of liquid 11 stored in a companion chamber means 20 to act like a membrane under tension so that such liquid 11 is retained in the companion chamber means 20 while web 22 is level and while web 22 is inclined with respect to a horizontal plane at an acute angle θ (e.g., 50°) as suggested in FIGS. 8 and 9. Border edge 22E is hexagon-shaped in an illustrative embodiment. Tray side wall 18W extends upwardly away from a top side of web 22 in a first direction and basin side wall 18W extends downwardly from an underside of web 22 in a second direction as shown, for example, in FIGS. 1 and 9.

In a second embodiment of the present disclosure shown, for example, in FIGS. 10 and 11, a food-storage tray 100 includes a tray floor 112 and a tray side wall 114. Tray floor 112 is formed to include a plurality of micro-bore reservoirs 131, 132, and 133 as suggested in FIGS. 10 and 11. Each micro-bore reservoir 131, 132, and 133 provides chamber means 20 for receiving and retaining minute quantities of liquid 11 discharged from food deposited into product-storage region 16 and supported on a web 122 included in tray floor 112.

A first group of the micro-bore reservoirs 131 are formed in web 122 and arranged to open into product-storage region 16 formed in the food-storage tray as suggested in FIGS. 10 and 11. A second group of the micro-bore reservoirs 132, 133 are formed in one of the liquid-storage basins 118 and arranged to open into the chamber 20 of such liquid-storage basin 118.

Each of micro-bore reservoirs 131 in the first group is formed in web 122 and includes a reservoir floor 131F located in the tray floor 112 in a position between an inner surface 112I of tray floor 112 and an outer surface 112O of tray floor 112 as suggested in FIG. 11. Inner surface 112I of tray floor 112 faces into product-storage region 16 and outer surface 112O of tray floor 112 faces away from product-storage region 16. Each of micro-bore reservoirs 131 in the first group also includes reservoir side wall 131W extending from reservoir floor 131F to inner surface 1211 of tray floor 112 and cooperating with reservoir floor 131F to define a micro-volume liquid-receiving space as suggested in FIG. 11. An illustrative view of one of micro-bore reservoirs 131 is provided in FIG. 11A.

Each of the micro-bore reservoirs 132 in a first subset of the second group is formed in a basin side wall 118W and includes a reservoir floor 132F located in tray floor 112 between outer surface 112O of tray floor 112 and the basin floor 118F of one of liquid-storage basins 118. Each of the micro-bore reservoirs 132 in the first subset of the second group also includes a reservoir side wall 132W coupled to each of reservoir floor 132F and basin floor 118 and arranged to interconnect reservoir floor 132F and basin floor 118F as suggested in FIG. 11.

Each of the micro-bore reservoirs 133 in a second subset of the second group includes a reservoir floor 133F located in tray floor 112. Each of the micro-bore reservoirs 133 in the second group also includes a reservoir side wall 133W coupled to each of reservoir floor 133F and basin side walls 118W and arranged to interconnect reservoir floor 133F and basin side wall 118W as suggested in FIG. 11.

In another embodiment of the present disclosure shown, for example, in FIGS. 12 and 13, a food-storage tray 200 includes a multi-layer tray floor 212 and a tray side wall 214. Tray floor 212 includes an upper layer 212U and a lower layer 212L. Upper layer 212U may be made of any suitable material and adhered to lower layer 212L in any suitable manner.

Upper layer 212U comprises the inner surface 212I and portions of web 322 and liquid-storage basins 218. Lower layer 212L lies under upper layer 212U and comprises the outer surface 212O and portions of web 322 and liquid-storage basins 218.

A first group of the micro-bore reservoirs 231 is formed in a portion of upper layer 212U included in web 322 and arranged to open into product-storage region 16. A second group of the micro-bore reservoirs 232, 233 is formed in a portion of upper layer 212U included in one of the liquid-storage basins 218 and arranged to open into the chamber 20 of such liquid-storage basin 218.

Each of the micro-bore reservoirs 231 in the first group includes a reservoir floor 231F located in tray floor 212 in a position between inner and outer surfaces 212I, 212O of tray floor 212 and a reservoir side wall 231W extending from the reservoir floor 231F to inner surface 212I of tray floor 212 as suggested in FIG. 13. An illustrative view of one of micro-bore reservoirs 231 is provided in FIG. 13A. Reservoir floor 231F can be defined by lower layer 212L as shown or by a portion of upper layer 212U within the scope of the present disclosure.

Each of the micro-bore reservoirs 232 in a first subset of the second group includes a reservoir floor 232F located in tray floor 212 between the outer surface 212O of tray floor 212 and the basin floor 218F of one of liquid-storage basins 218. Each of the micro-bore reservoirs 232 in a first subset of the second group also includes a reservoir side wall 232W coupled to each of the reservoir floor 232F and the basin floor 218F and arranged to interconnect the reservoir floor 232F and the basin floor 218F as suggested in FIG. 13.

Each of the micro-bore reservoirs 233 in a second subset of the second group includes a reservoir floor 233F located in tray floor 212. Each of the micro-bore reservoirs 233 in a second subset of the second group also includes a reservoir side wall 233W coupled to each of reservoir floor 233F and basin side wall 218W and arranged to interconnect the reservoir floor 233F and the basin side wall 218W as suggested in FIG. 13.

The invention claimed is:

1. A food-storage tray comprising a tray floor; and a tray side wall arranged to extend along an edge of the tray floor and to cooperate with the tray floor to form a product-storage region, wherein the tray floor is formed to include an array of liquid-storage basins and a web coupled to the tray side wall and to a brim of each of the liquid-storage basins, wherein each of the liquid-storage basins is formed to include chamber means communicating with the product-storage region for receiving and retaining liquid discharged from food deposited into the product-storage region and supported on the web so that such liquid is collected in at least one of the chamber means without the use of any separate absorbent pad supported on the web and located between the web and the food;

wherein the tray floor is formed to include a plurality of micro-bore reservoirs and each micro-bore reservoir provides means for receiving and retaining minute quantities of liquid discharged from food deposited into the product-storage region and supported on the web; and wherein the tray floor includes an inner surface facing into the product-storage region and an outer surface facing away from the tray floor, the tray floor includes an upper layer comprising the inner surface and portions of the web and the liquid-storage basins and a lower layer lying under the upper layer and comprising the outer surface and portions of the web and the liquid-storage basins and wherein a first group of the micro-bore reservoirs are formed in the web and arranged to open into the product-storage region and a second group of the micro-bore reservoirs are formed in one of the liquid-storage basins and arranged to open into the chamber means of such liquid-storage basin.

2. The food-storage tray of claim 1, wherein each liquid-storage basin includes a basin floor located below and in spaced-apart relation to the web and a basin side wall arranged to interconnect the basin floor and the web and cooperate with the basin floor to define the chamber means thereof.

3. The food-storage tray of claim 2, wherein the basin floor has a hexagonal shape and six serially connected side edges and the basin side wall has a hexagonal shape in cross section and comprises a series of six serially connected panels and each of the panels is coupled to one of the six serially connected side edges included in the basin floor.

4. The food-storage tray of claim 3, wherein the web is formed to include an array of basin apertures, each basin aperture opens into the chamber means formed in one of the liquid-storage basins, each basin aperture has a hexagonal shape and is bordered by a border edge comprising a series of six serially connected web segments, and each of the six serially connected panels is coupled to a companion one of the web segments.

5. The food-storage tray of claim 3, wherein each of the panels is flat.

6. The food-storage tray of claim 3, wherein each of the panels has a rectangular shape.

7. The food-storage tray of claim 2, wherein the basin side wall is configured to design surface-tension means for causing a free surface of liquid stored in the chamber means bounded by the basin side wall to act like a membrane under tension so that such liquid is retained in the chamber means while the web is level and while the web is inclined with respect to a horizontal plane.

8. The food-storage tray of claim 2, wherein the web is formed to include an array of basin apertures, each basin aperture is arranged to open into the chamber means formed in one of the liquid-storage basins and is bordered by a border edge comprising a series of serially connected web segments arranged at angles to one another, and the basin side wall is coupled at a lower end thereof to a companion basin floor and at an upper end thereof to the series of serially connected web segments that cooperate to define a companion basin aperture.

9. The food-storage tray of claim 8, wherein the series of serially connected web segments cooperate to define surface-tension means for causing a free surface of liquid stored in a companion chamber means to act like a membrane under tension so that such liquid is retained in the companion chamber while the web is level and while the web is inclined with respect to a horizontal plane at an acute angle of about 30°.

10. The food-storage tray of claim 9, wherein the border edge is hexagon-shaped.

11. The food-storage tray of claim 9, wherein the tray side wall extends upwardly away from a top side of the web in a first direction and the basin side wall extends downwardly from an underside of the web in a second direction.

12. The food-storage tray of claim 1, wherein the web is formed to include an array of basin apertures, each basin aperture is arranged to open into the chamber means formed in one of the liquid-storage basins and is bordered by a border edge comprising a series of serially connected web segments arranged at angles to one another and coupled to the brim of the liquid-storage basin, and the series of serially connected web segments cooperate to define surface-tension means for causing a free surface of liquid stored in a companion chamber means to act like a membrane under tension so that such liquid is retained in the companion chamber while the web is level and while the web is inclined with respect to a horizontal plane at an acute angle of about 30°.

13. The food-storage tray of claim 1, wherein a first group of the micro-bore reservoirs are formed in the web and arranged to open into the product-storage region and a second group of the micro-bore reservoirs are formed in one of the liquid-storage basins and arranged to open into the chamber means of such liquid-storage basin.

14. The food-storage tray of claim 13, wherein each of the micro-bore reservoirs in the first group includes a reservoir floor located in the tray floor in a position between an inner surface of the tray floor facing into the product-storage region and an outer surface of the tray floor facing away from the product-storage region and a reservoir side wall extending from the reservoir floor to the inner surface of the tray floor and cooperating with the reservoir floor to define a micro-volume liquid-receiving space.

15. The food-storage tray of claim 13, wherein each liquid-storage basin includes a basin floor located below and in spaced-apart relation to the web and a basin side wall arranged to interconnect the basin floor and the web and cooperate with the basin floor to define the chamber means thereof, the tray floor includes an inner surface of the tray floor facing into the product-storage region and an outer surface of the tray floor facing away from the product-storage region, and each of the micro-bore reservoirs in a first subset of the second group includes a reservoir floor located in the tray floor between the outer surface of the tray floor and the basin floor of one of the liquid-storage basins and a reservoir side wall coupled to each of the reservoir floor and the basin floor and arranged to interconnect the reservoir floor and the basin floor.

16. The food-storage tray of claim 13, wherein each liquid-storage basin includes a basin floor located below and in spaced-apart relation to the web and a basin side wall arranged to interconnect the basin floor and the web and cooperate with the basin floor to define the chamber means thereof and the tray floor includes an inner surface of the tray floor facing into the product-storage region and an outer surface of the tray floor facing away from the product-storage region and a reservoir side wall extending from a reservoir floor to the inner surface of the tray floor, and each of the micro-bore reservoirs in a second subset of the second group includes a reservoir floor located in the tray floor and a reservoir side wall coupled to each of and arranged to interconnect the reservoir floor and the basin side wall.

17. The food-storage tray of claim 1, wherein each of the micro-bore reservoirs in the first group includes a reservoir floor located in the tray floor in a position between an inner surface of the tray floor facing into the product-storage region and an outer surface of the tray floor facing away from the product-storage region and a reservoir side wall extending from the reservoir floor to the inner surface of the tray floor.

18. The food-storage tray of claim 1, wherein each liquid-storage basin includes a basin floor located below and in spaced-apart relation to the web and a basin side wall arranged to interconnect the basin floor and the web and cooperate with the basin floor to define the chamber means thereof and wherein the tray floor includes an inner surface of the tray floor facing into the product-storage region and an outer surface of the tray floor facing away from the product-storage region and a reservoir side wall extending from a reservoir floor to the inner surface of the tray floor and each of the micro-bore reservoirs in a first subset of the second group includes a reservoir floor located in the tray floor between the outer surface of the tray floor and the basin floor of one of the liquid-storage basins and a reservoir side wall coupled to each of the reservoir floor and the basin floor and arranged to interconnect the reservoir floor and the basin floor.

19. The food-storage tray of claim 1, wherein each liquid-storage basin includes a basin floor located below and in spaced-apart relation to the web and a basin side wall arranged to interconnect the basin floor and the web and cooperate with the basin floor to define the chamber means thereof and the tray floor includes an inner surface of the tray floor facing into the product-storage region and an outer surface of the tray floor facing away from the product-storage region and a reservoir side wall extending from a reservoir floor to the inner surface of the tray floor, and each of the micro-bore reservoirs in a second subset of the second group includes a reservoir floor located in the tray floor and a reservoir side wall coupled to each of and arranged to interconnect the reservoir floor and the basin side wall.

* * * * *